US006394943B1

(12) United States Patent
Cormier et al.

(10) Patent No.: US 6,394,943 B1
(45) Date of Patent: May 28, 2002

(54) IMAGE TRANSFER DRUM FOR DOCUMENT PRINTER/COPIER

(76) Inventors: Steven Cormier; James D. Shifley, both of NexPress Solutions LLC 1447 St. Paul St., Rochester, NY (US) 14653-7001; Gregory L. Kowalski, NexPress Solutions LLC1447 St. Paul St., Rochester, NY (US) 14653

( * ) Notice: Subject to any disclaimer, the term of this patent is extended or adjusted under 35 U.S.C. 154(b) by 0 days.

(21) Appl. No.: 09/574,447

(22) Filed: May 19, 2000

(51) Int. Cl.[7] ..... B25F 5/02

(52) U.S. Cl. ..... 492/47; 492/4; 29/895.21; 29/895.23; 101/375

(58) Field of Search ..... 492/47, 56, 4; 29/895.2, 895.21, 895.23, 895.3, 446; 101/375, 351.7, 217

(56) References Cited

U.S. PATENT DOCUMENTS

| | | | | |
|---|---|---|---|---|
| 2,365,980 A | * | 12/1944 | Katz | 101/375 |
| 3,146,709 A | * | 9/1964 | Bass et al. | 101/375 |
| 4,030,415 A | * | 6/1977 | Fellows | 101/375 |
| 4,119,032 A | | 10/1978 | Hollis | 101/216 |
| 4,794,858 A | * | 1/1989 | Katz | 101/375 |
| 4,812,219 A | * | 3/1989 | Sattrup et al. | 101/375 |
| 4,903,597 A | * | 2/1990 | Hoage et al. | 101/375 |
| 5,819,657 A | * | 10/1998 | Rossini | 101/375 |
| 6,276,271 B1 | * | 8/2001 | Busshoff | 101/375 |

OTHER PUBLICATIONS

U.S. Patent application Ser. No. 09/574,275, filed May 19, 2000.

U.S. Patent application Ser. No. 09/574,425, filed May 19, 2000.

* cited by examiner

*Primary Examiner*—S. Thomas Hughes
*Assistant Examiner*—Marc Jimenez

(57) ABSTRACT

A drum assembly comprises a replaceable sleeve of resilient material supported by a rigid cylindrical mandrel having an air bearing at one end to facilitate loading and removal of the resilient sleeve. The air bearing is provided by a pair of cooperating plates one of which is scored with equally spaced and radially extending slots. When urged together, the plates define a central air chamber and a plurality of radially-extending passages serving to direct pressurized air radially from one end of the mandrel.

9 Claims, 5 Drawing Sheets

IMAGE TRANSFER DRUM FOR DOCUMENT PRINTER/COPIER

CROSS-REFERENCE TO RELATED APPLICATIONS

Reference is made to the commonly assigned U.S. Patent Applications, the respective disclosures of which being incorporated herein by reference:

(1) U.S. application Ser. No. 09/574,425, filed concurrently herewith and entitled "Document Printer/Copier with Decoupleable Drum-Support Member".

(2) U.S. application Ser. No. 09/574,275, filed concurrently herewith and entitled "Cantilever Drum Mount for Document Printer/Copier".

FIELD OF THE INVENTION

The present invention relates to field of printing and copying. More particularly, it relates to improvements in the structure of printing or image-transfer drums of the type having a resilient outer sleeve that are supported by an underlying mandrel. Such drums are used, for example, in electrostatic document printers and copiers for temporarily receiving a toner image from an image-recording element before there is re-transferred to an image-receiver sheet or the like.

BACKGROUND OF THE INVENTION

In printing machines, copiers and the like, images are often formed on or transferred to a drum having a flexible or resilient outer sleeve that, from time to time, requires replacement. Typically, the sleeve is operatively supported by a metal cylinder or mandrel. In loading the sleeve onto the mandrel, it is common to inject air into the sleeve, thereby slightly expanding the sleeve diameter, while sliding the sleeve axially onto the mandrel's supporting surface. Usually, the nominal diameter of the resilient sleeve is slightly less than the mandrel diameter. Thus, upon discontinuing the air flow, the sleeve contracts onto the mandrel and forms a tight, interference fit.

In drum assemblies of the type described above, it is known to machine air ports or holes in the sleeve-loading end of the mandrel. See, e.g., the disclosure of U.S. Pat. No. 4,119,032. Air supplied through the mandrel interior emerges through these air ports and provides an air bearing for expanding the sleeve. A uniform air bearing that is sufficient to expand a sleeve of relatively non-elastic material often necessitates a close and uniform spacing of the air ports in the mandrel surface. This need can be problematic from a manufacturing cost standpoint when the mandrel is of relatively large diameter and/or is made of a relatively hard substance.

SUMMARY OF THE INVENTION

In view of the foregoing discussion, an object of this invention is to provide a low-cost mandrel assembly for supporting a flexible sleeve of the type described.

According to one aspect of the invention, a mandrel for supporting a removable outer sleeve comprises: (a) a cylindrical tube of predetermined outer diameter; and (b) a circular end plate positioned at one end of the tube and operatively connected thereto. The end plate has a diameter substantially equal to the predetermined outer diameter of the cylindrical tube and has a plurality of radially-extending slots formed in a planar surface thereof that faces inwardly, toward the center of said tube. The slots are sufficiently long to extend from a centrally-located annular recess formed in the planar surface to the perimeter of the end plate. A pressure plate is operatively connected to the end plate and has a surface that cooperates with the slotted and recessed planar surface of the end plate to define a centrally-located air chamber and a plurality of radially-extending air passageways connecting the air chamber and the perimeter of the end plate. Upon connecting the air chamber to a source of pressurized air, a plurality of radially extending air streams are created at the periphery of the end plate. According to a preferred embodiment, both the end plate and said pressure plate are made of plastic, whereby the cylindrical tube and a supporting axle, both of which are made of metal, can be electrically isolated. This is particularly useful when the drum surface is to be electrically biased relative to a machine frame that supports the axle. Also preferred is that the peripheral edge of the end plate is tapered to facilitate the loading of the removable sleeve onto said mandrel.

By virtue of having the air ports of the air bearing defined by a pair of confronting plates, each preferably being molded from plastic, the above-noted machining process of prior art mandrel is obviated. Thus, the manufacturing costs are significantly reduced.

The invention and its advantages will be better understood from the ensuing detailed description of preferred embodiments, reference being made to the accompanying drawings in which like reference characters denote like parts.

DETAILED DESCRIPTION OF PREFERRED EMBODIMENTS

Figure 1:
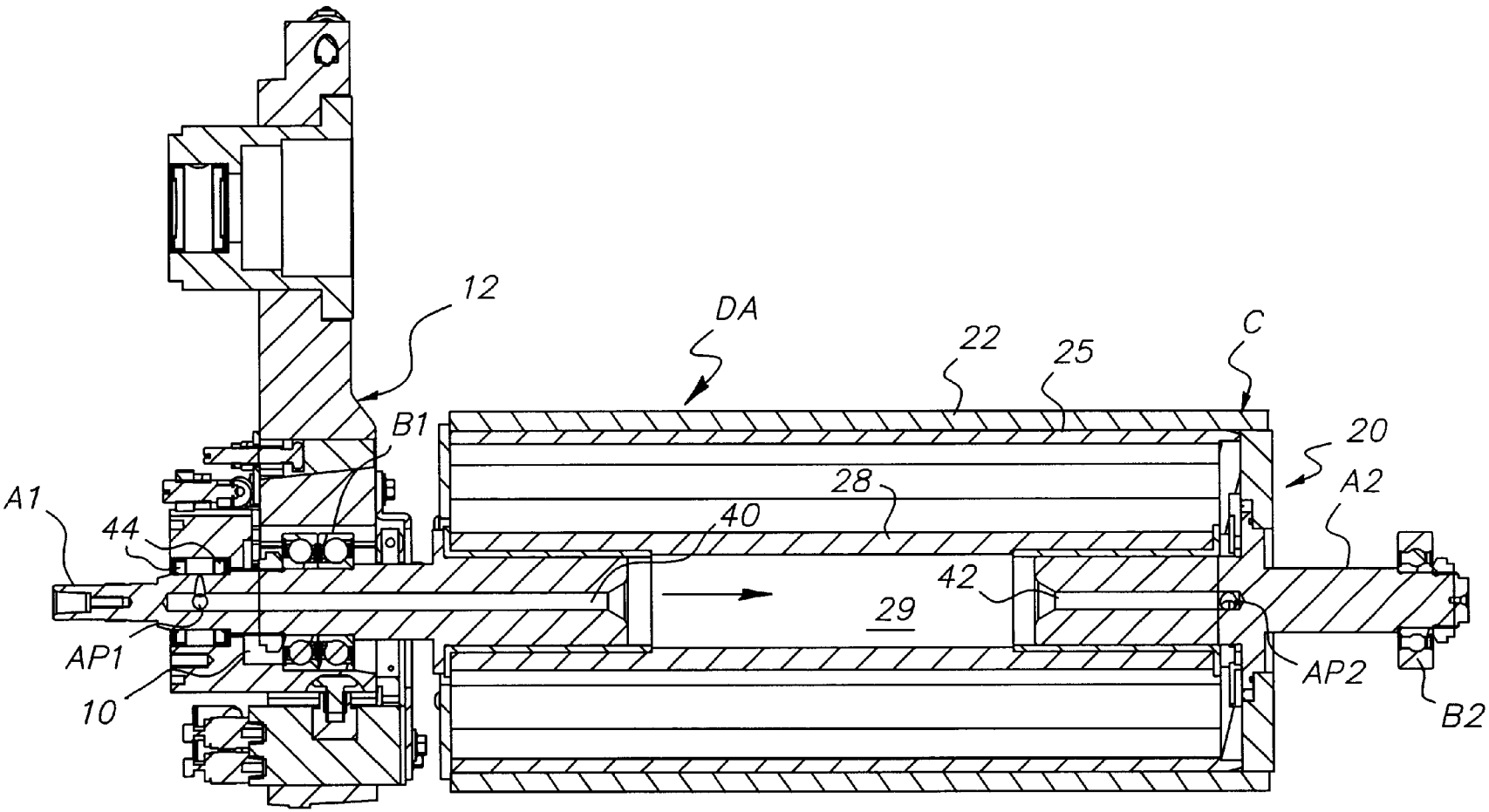
FIG. 1 is a cross-sectional illustration of a drum assembly embodying the invention.
Figure 2:
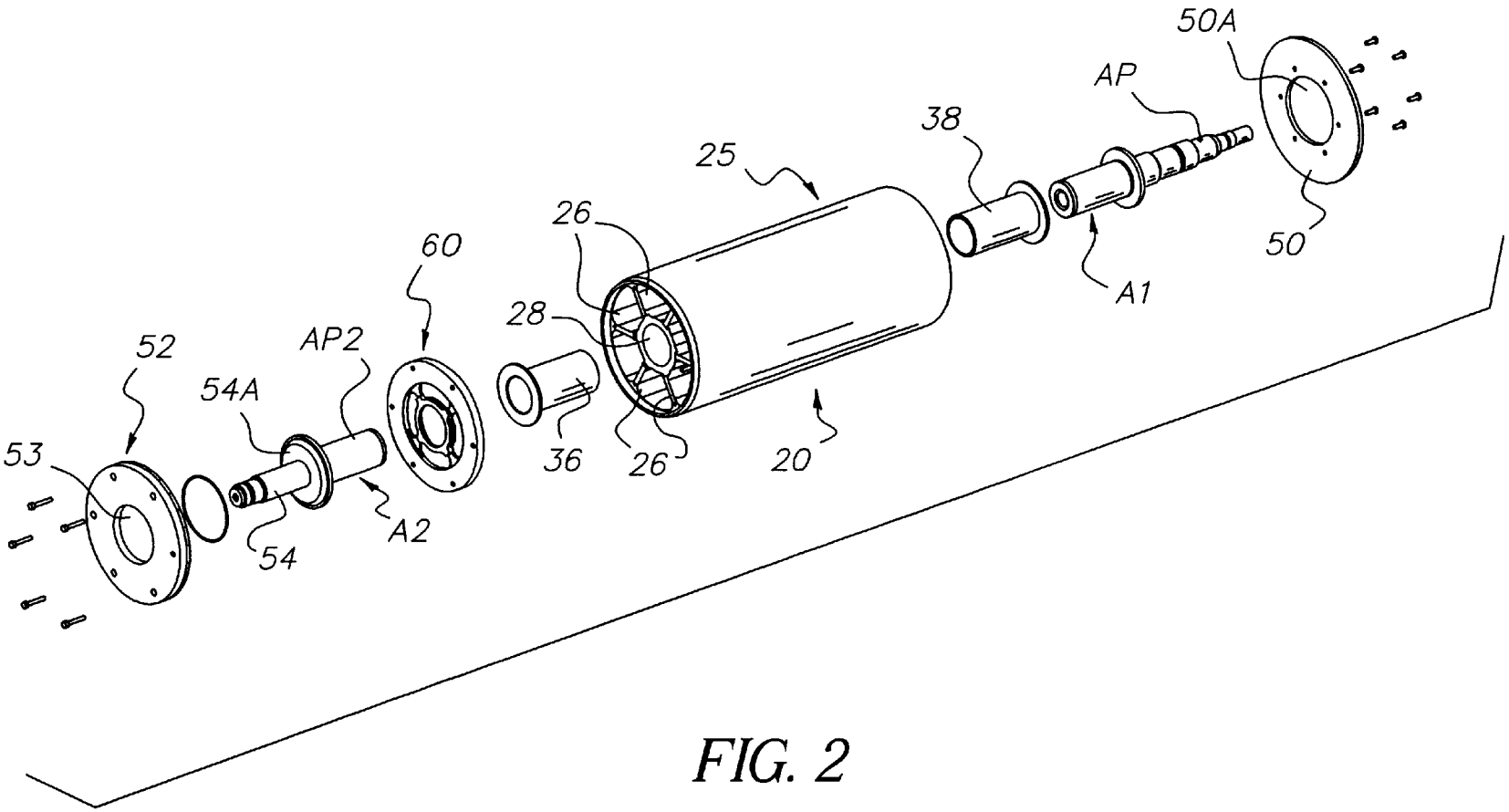
FIG. 2 is an exploded view of a preferred embodiment of the invention.

Referring now to the drawings, FIG. 1 shows a drum assembly DA of the type used as an intermediate image-transfer drum used in an electrophotographic document printer/copier. An example of such an apparatus is disclosed in the above-referenced Applications filed concurrently herewith. The drum assembly is supported for rotation by rear and front stub axles A1 and A2, respectively. Rear axle A1 carries a double ring ball bearing B1 which is mounted in a movable carriage 10 contained in a drum-support member 12. The latter serves to support the drum assembly in a cantilever fashion when a front drum-support member (not shown) has been decoupled from the drum assembly's front axle bearing B2 and moved to a standby position where it does not interfere with servicing of the drum assembly, as described below. Details of the drum assembly support are disclosed in the above-referenced U.S. application Ser. No. 09/574,425. Details of the movable front drum support are disclosed in the above-referenced U.S. application Ser. No. 09/574,275.

Drum assembly DA basically comprises a cylindrical mandrel 20 that supports a flexible sleeve 22. In the case where the drum assembly constitutes an image-transfer drum in an electrophotographic printer/copier or the like, sleeve 22 may comprise a thin, flexible band of nickel or the like having a relatively compliant outer layer of urethane. Sleeve 22 is sized to slide axially, as indicated by the arrows, onto the outer surface of the mandrel and be supported thereby with an interference fit. To facilitate loading of sleeve 22 onto the mandrel, an air bearing is established (as described below) around the entire circumference of the mandrel in the vicinity of region C, i.e., in the vicinity of the free end of the mandrel. Upon fitting a portion of the end of sleeve 22 over this air bearing, a sufficient volume of air will be trapped between the mandrel and the inside surface of the sleeve to cause the sleeve to expand slightly. At this point, the remainder of the sleeve can be easily slid over the entire surface of the mandrel to the position shown in FIG. 1. When air is no longer applied to region C, the sleeve contracts and seats snugly on the mandrel surface.

Referring now to the exploded view of PIG. 2, mandrel 20 is shown to comprise a cylindrical metal tube 25 having a plurality of internal struts 26 that extend radially, from the inside surface of tube towards the tube's central (longitudinal) axis. The respective free ends of the struts are connected to, and thereby support, a second tube 28 that is concentrically arranged with respect to tube 25 and is co-extensive therewith. Thus, tube 28 provides an enclosed cylindrical air passage 29 from one end of tube 25 to the other. Preferably tube 25 and its internal structure is made of extruded aluminum.

In addition to providing an air passage through tube 25, the internal second tube 28 serves to support the stub axles Al and A2 which, as noted above, extend outwardly from opposite ends of the mandrel. Each axle is preferably made of stainless steel. To electrically isolate the stub axles from tube 25 so that an electrical bias voltage may be applied to the drum independent of the electrical potential of the drum support, it is preferred that a pair of non-conductive, preferably plastic, bushings 36, 38 be interposed between the inside surface of tube 28 and the axles.

Referring to FIG. 1, each of the stub axles A1 and A2 has an internal, axially extending internal passage, 40, 42, respectively, which communicates with air passage 29 defined by tube 28. Note, axle passages 40 and 42 extend only partially through their respective axle, each axle being closed at its outside end. Passage 40 in axle A1 communicates with a radially-extending airport AP1 to which air may be selectively applied from an external source to introduce air to the interior of the mandrel, more specifically, into passages 40,42 and 29. Passage 42 in axle A2 communicates with a pair of radially-extending air ports AP2 through which pressurized air can exit from passage 42 and enter an air chamber defined by plated 52 and 60, discussed below. As shown in FIG. 1, the free end of axle A1 supports a pair of seals 44 which cooperate with walls of the drum support carriage 10 to define a sealed region surrounding axle A1 to which pressurized air can be applied, through air port AP, and thus introduce air into the aforementioned passages even as the drum axle rotates in bearing B1. The rear end of drum 25 is capped by an end plate 50 which is attached to the radial struts 26 by bolts or other suitable means. Note, end plate 50 has a central opening 50A that is sufficiently large as not to contact the circular flange 51 on axle A1 and thereby electrically short the axle and tube 25.

Figure 3:
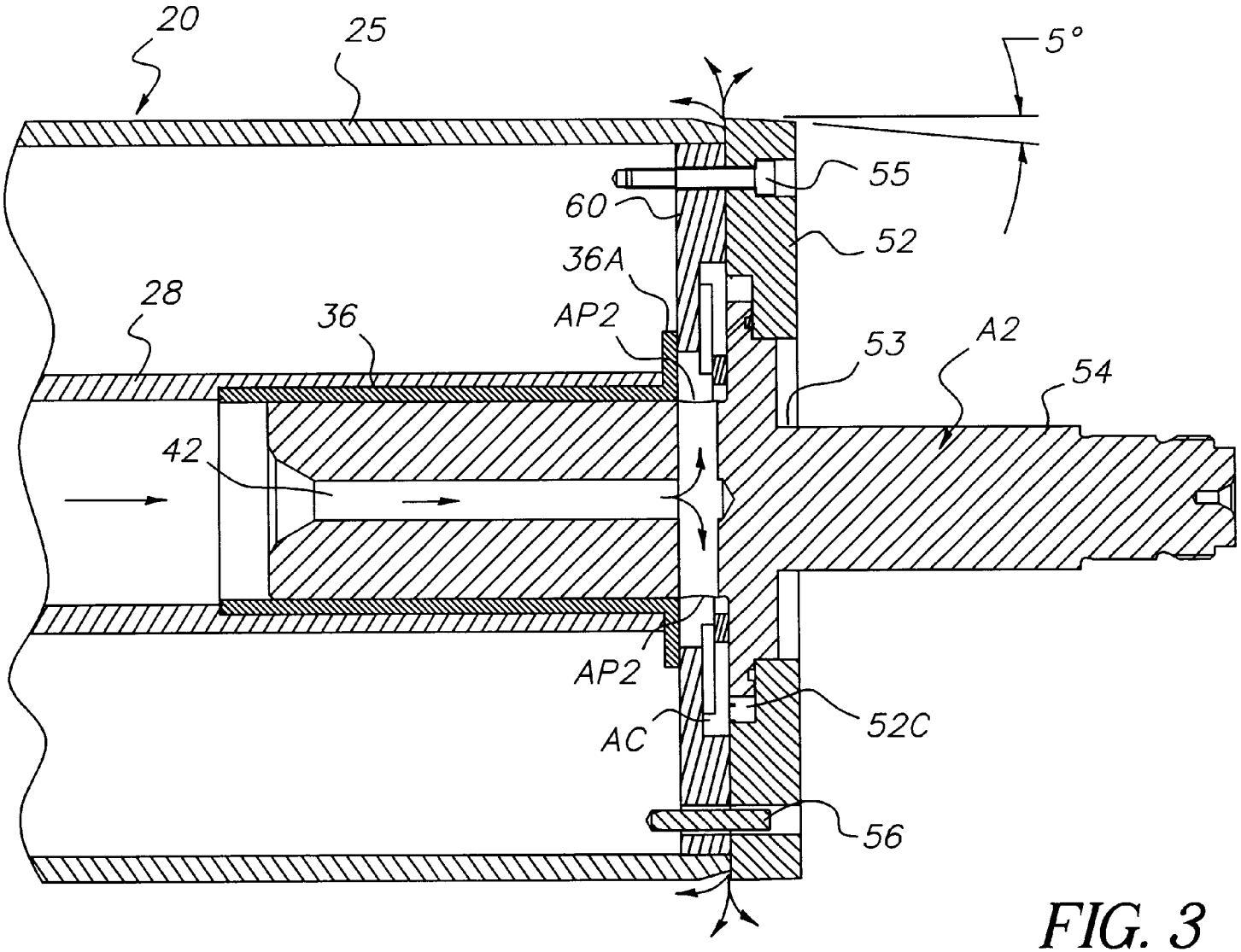
FIG. 3 is an enlarged perspective view of the free end portion of the drum assembly shown in FIG. 1.
Figure 4:
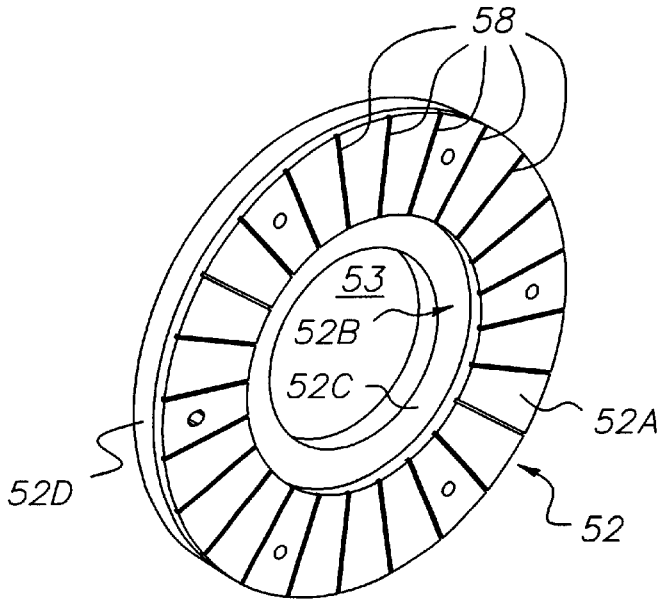
FIGS. 4 and 5 are enlarged perspective views of two components of the drum assembly shown in FIG. 1.
Figure 5:
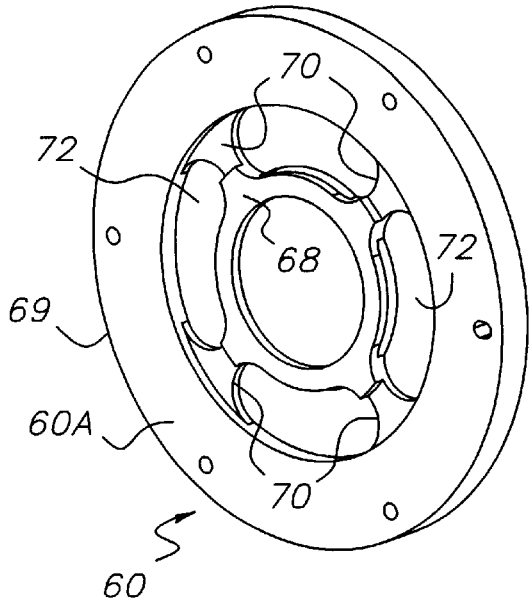
Figure 6:
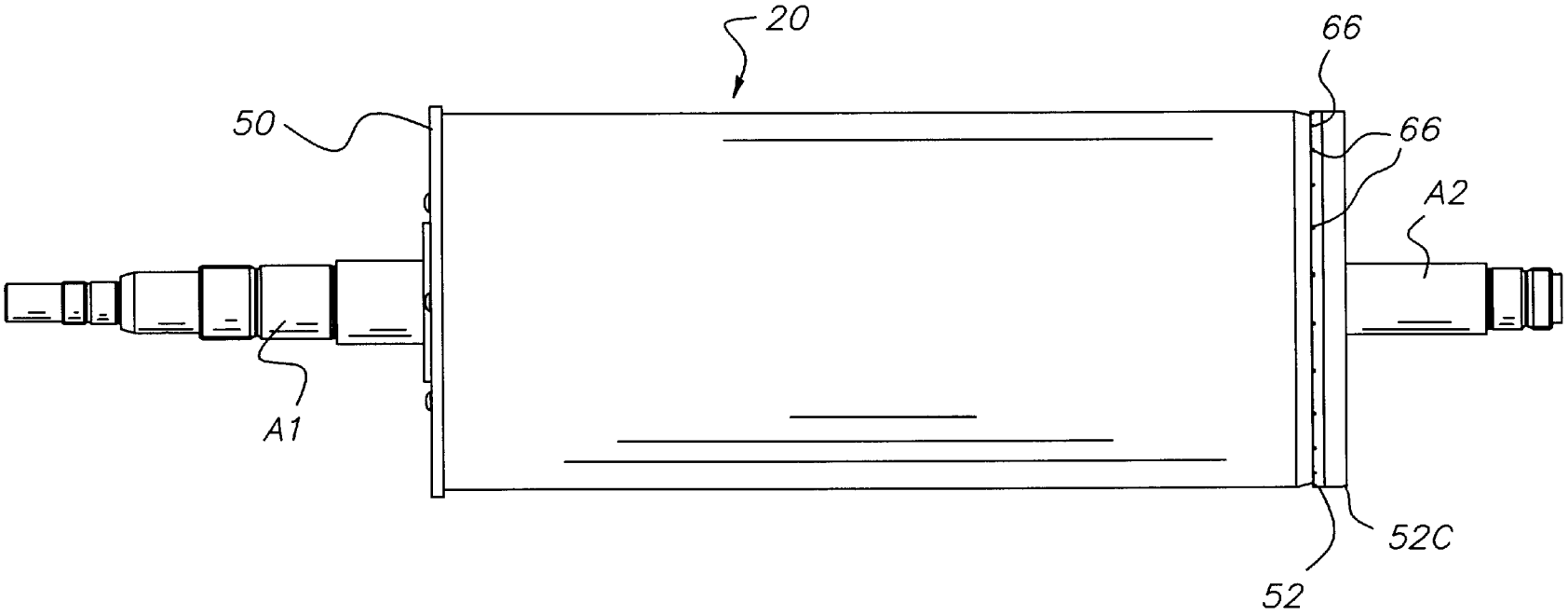
FIG. 6 is a front plan view of the drum mandrel shown in FIG. 1.

Referring now to FIGS. 3–5, the front end 25A of tube 25 is capped by a circular end plate 52 that is connected to the internal struts 26 of tube 25 by a set of bolts 55 and pins 56. End plate 52 has a diameter substantially equal to the outer diameter of tube 25 and has a circular opening 53 through which the free end 54 of stub axle A2 projects. A flange 52B of reduced thickness surrounds opening 53 and defines an annular recess 52C in the planar surface 52A of the plate. When plate 52 is bolted to tube 25, a portion of flange 52B engages a flange 54A on axle A2 and urges the axle flange inwardly, toward engagement with a pressure plate 60, discussed below. Plate 52 has a plurality of radially-extending slots 58 formed in a planar surface 52A thereof that faces inwardly toward the center of said tube. The slots extend from the centrally-located annular recess 52C formed in the planar surface to the circular perimeter of the end plate. Preferably, each of the slots has a square cross-section, about 0.5 to 2 mm. on a side. End plate 52 is preferably made plastic by an injection molding process.

Positioned against the slotted surface of end plate 52 and attached thereto by the same bolts used to connect plate 52 to tube 25 is a pressure plate 60. Plate 60 is also made of injection-molded plastic and has a planar surface 60A that cooperates with the slotted planar surface 52A of end plate 52 to define a plurality of radially-extending air passageways 66 connecting the annular recess 52C and the perimeter of said end plate. Radially inward from surface 60A is an annular ring 68 connected to the outer annulus 69 by a plurality of spoke-like members 70. Between the spoke members are openings 72. When bolted together, ring 68 rests upon an outer rim portion 36A of bushing. Air emerging through airports AP2 is thus confined to openings 72 which, in turn, communicate with the annular recess 52C to define an internal air chamber for supplying the radially-extending passageways 66 with pressurized air. Thus, when air is applied to the mandrel through airport AP1, a plurality of radially extending air streams are created at the periphery of the end plate, thereby producing an air bearing at the interface of tube 25 and end plate 52, as shown in FIG. 3. Preferably, the peripheral edge 52D of said end plate 52 is tapered at about 5 degrees (as shown in FIG. 3) to facilitate the loading of the removable resilient sleeve 22 onto the mandrel.

As a result of the above-described structure, the need for a costly machining process for producing air ports in solid surface is avoided. The air bearing effect is achieved with greater precision through the use of low cost, injection moldable components.

The invention has been described with reference to a particularly preferred embodiment. It will be apparent, however, that certain modifications can be made without departing from the spirit of the invention, and such modifications are intended to be protected by the following claims.

What is claimed is:

1. A drum assembly comprising a cylindrical mandrel adapted to support a removable outer sleeve of resilient material, said mandrel comprising:

(a) a cylindrical tube of predetermined outer diameter;

(b) a circular end plate positioned at one end of said tube and operatively connected thereto, said end plate having a diameter substantially equal to the predetermined outer diameter of said cylindrical tube and having a plurality of radially-extending slots formed in a planar surface thereof that faces inwardly toward the center of said tube, said slots extending from a centrally-located annular recess formed in said planar surface to the perimeter of said end plate; and (c) a pressure plate operatively connected to said end plate and having a surface that cooperates with the slotted and recessed planar surface of said end plate to define a centrally-located air chamber and a plurality of radially-extending air passageways connecting said air chamber and the perimeter of said end plate, said air chamber being connectable to a source of pressurized air, whereby a plurality of radially extending air streams are created at the periphery of said end plate when pressurized air is introduced into said air chamber.

2. The apparatus as defined by claim 1 wherein said end plate and said pressure plate are made of plastic.

3. The apparatus as defined by claim 1 wherein the peripheral edge of said end plate is tapered to facilitate the loading of said removable resilient sleeve onto said mandrel.

4. The apparatus as defined by claim 3 wherein said taper is about 5 degrees.

5. A drum assembly comprising a mandrel adapted to support a removable outer sleeve of resilient material, said mandrel comprising:

(a) a cylindrical tube of predetermined outer diameter and having opposing ends connected by a rigid fluid passageway therebetween;

(b) a pair of drum axles, each drum axle extending outwardly from opposite ends of said fluid passageway along a desired axis of drum rotation, and each drum axle having an axially-extending internal passage for conducting pressurized air provided by an external source, the respective internal passages of said drum axles being in fluid communication with each other via said rigid fluid passageway of said tube, one of said drum axles having an air-inlet port for introducing pressurized air into said passageways, and the other of said axles having an air-outlet port;

(c) a pair of circular end plates positioned at the opposing ends of said tube and operatively connected thereto, each of said end plates having a central opening therein surrounding one of said drum axles, one of said end plates having a diameter substantially equal to the predetermined outer diameter of said cylindrical tube and having a plurality of radially-extending slots formed in a planar surface thereof that faces inwardly toward the center of said tube, said slots extending from a centrally-located annular recess formed in said planar surface to the perimeter of said one end plate;

(d) a pressure plate operatively connected to said one end plate and having a surface that cooperates with the slotted and recessed planar surface of said one end plate to define a centrally-located air chamber and a plurality of radially-extending air passageways connecting said air chamber and the perimeter of said one end plate, said air chamber being in fluid communication with said air-outlet port, whereby a plurality of radially extending air streams are created at the periphery of said one end plate when pressurized air is applied to said air-inlet port.

6. The apparatus as defined by claim 5 wherein drum axles and cylindrical tube are made of electrically conductive material, and wherein said tube and said drum axles are electrically isolated by a pair electrically insulating bushings positioned therebetween.

7. The apparatus as defined by claim 6 wherein said one end plate and said pressure plate are made of plastic.

8. The apparatus as defined by claim 5 wherein said cylindrical tube and fluid passageway are concentrically arranged and are integrally formed from an extruded metal.

9. The apparatus as defined by claim 5 wherein the peripheral edge of said one end plate is tapered to facilitate the loading of said removable resilient sleeve onto said mandrel.

* * * * *